US010221379B2

(12) United States Patent
Detroch et al.

(10) Patent No.: US 10,221,379 B2
(45) Date of Patent: Mar. 5, 2019

(54) THICKENED OR STRUCTURED LIQUID DETERGENT COMPOSITIONS

(71) Applicant: The Procter & Gamble Company, Cincinnati, OH (US)

(72) Inventors: Liesbet Maria Cornelia Detroch, Machelen (BE); Susana Fernandez-Prieto, Bennicassim/Castellon (ES); Vincenzo Guida, Woluwe-Saint-Pierre (BE); Michael Klostermann, Essen (DE); Hans-Jürgen Köhle, Hanau (DE); Bruno Jean-Pierre Matthys, Brussels (BE); Johan Smets, Lubbeek (BE); Gonglu Tian, Henrico, VA (US)

(73) Assignee: The Procter & Gamble Company, Cincinnati, OH (US)

( * ) Notice: Subject to any disclaimer, the term of this patent is extended or adjusted under 35 U.S.C. 154(b) by 71 days.

(21) Appl. No.: 15/439,976

(22) Filed: Feb. 23, 2017

(65) Prior Publication Data

US 2017/0247646 A1 Aug. 31, 2017

Related U.S. Application Data

(60) Provisional application No. 62/300,096, filed on Feb. 26, 2016.

(51) Int. Cl.

| | |
|---|---|
| ***C11D 1/00*** | (2006.01) |
| ***C11D 3/32*** | (2006.01) |
| ***C11D 17/04*** | (2006.01) |
| ***C11D 1/22*** | (2006.01) |
| ***C11D 3/20*** | (2006.01) |
| ***C11D 3/37*** | (2006.01) |
| ***C11D 3/386*** | (2006.01) |
| ***C11D 3/50*** | (2006.01) |
| ***C11D 11/00*** | (2006.01) |
| ***C11D 1/52*** | (2006.01) |
| ***C11D 17/00*** | (2006.01) |

(52) U.S. Cl.

CPC ..... *C11D 17/043* (2013.01); *C11D 1/22* (2013.01); *C11D 1/528* (2013.01); *C11D 3/2044* (2013.01); *C11D 3/32* (2013.01); *C11D 3/3723* (2013.01); *C11D 3/38627* (2013.01); *C11D 3/505* (2013.01); *C11D 11/0017* (2013.01); *C11D 17/0026* (2013.01)

(58) Field of Classification Search

CPC ..... C11D 1/00; C11D 3/2044; C11D 3/32; C11D 3/3723; C11D 3/38627; C11D 3/38672; C11D 17/042

See application file for complete search history.

(56) References Cited

U.S. PATENT DOCUMENTS

| | | | | |
|---|---|---|---|---|
| 3,951,853 | A | 4/1976 | Suwala | |
| 3,977,894 | A | 8/1976 | White et al. | |
| 2002/0198121 | A1 | 12/2002 | Nitzsche | |
| 2015/0203443 | A1 | 7/2015 | Klostermann et al. | |
| 2015/0274644 | A1* | 10/2015 | Bernard | C07C 235/10 106/287.25 |
| 2016/0312005 | A1 | 10/2016 | Bernard et al. | |

FOREIGN PATENT DOCUMENTS

| | | | | |
|---|---|---|---|---|
| JP | H04-145938 | * | 5/1992 | B01J 13/00 |
| WO | WO 2011/112887 | | 9/2011 | |

OTHER PUBLICATIONS

International Search Report for application No. PCT/US2017/018996, dated May 29, 2017, 15 pages.

Database WPI 1-3,5,7 ,Week 199226 10 Thomson Scientific, London, GB; AN 1992-214450 XP002770113, -& JP H04145938 A (Nippon 01 LS & Fats Co Ltd) May 19, 1992 (May 19, 1992) Y examples 16-18; table 1.

* cited by examiner

*Primary Examiner* — Brian P Mruk

(74) *Attorney, Agent, or Firm* — Andres E. Velarde; Melissa G. Krasovec

(57) ABSTRACT

Liquid detergent compositions can be stably structured using amides of an aliphatic polyamine with two, three or four molecules of fully saturated hydroxyl alkyl acids, even in the presence of hydrolyzing detergent ingredients such as lipase enzyme.

14 Claims, No Drawings

THICKENED OR STRUCTURED LIQUID DETERGENT COMPOSITIONS

FIELD OF THE INVENTION

The present invention relates to liquid detergent compositions comprising a thickener or structurant that is compatible with a broad range of detergent ingredients, including lipase enzyme.

BACKGROUND OF THE INVENTION

Thickeners are useful for adjusting the viscosity and the rheological behaviour of detergents compositions in order to make them easy to pour and dose. Structurants thicken, but also provide a suspensive benefit, allowing ingredients such as perfumes, particulates, and the like, to be stably suspended in the liquid detergent composition. Such structurants also prevent phase separation of liquid laundry detergents, such as separation into two liquid phases or settling of suspended solids.

Hydrogenated castor oil has been used traditionally for thickening and structuring aqueous detergent formulations. WO 2011/031940 describes a structuring system for liquid laundry detergents comprising from 2-10% by weight of crystals of hydrogenated castor oil, from 2-10% by weight of an alkanolamine and from 5-50% by weight of the anion of an anionic surfactant. However, hydrogenated castor oil is hydrolysed by lipase enzymes commonly used in laundry detergents and therefore cannot be used to thicken or structure liquid laundry detergents containing lipase enzymes, or other ingredients which hydrolyse hydrogenated castor oil.

WO 2011/112887 describes di-amido gellants for thickening detergent compositions that may comprise enzymes.

WO 2014/009027 describes 12-hydroxyoctadecanoic acid mono-amides for thickening aqueous surfactant compositions. The disclosed 12-hydroxyoctadecanoic acid mono-amides are stable to lipase enzymes.

U.S. Pat. No. 3,977,894 describes an organoclay rheological additive for non-aqueous fluids comprising an organically modified montmorillonite clay, glyceryl tri-12-hydroxystearate and a 12-hydroxystearic acid diamide of a $C_2$-$C_{18}$ alkylenediamine. The document also discloses the 12-hydroxystearic acid tetraamide of tetraethylene pentamine as not useful for this purpose.

U.S. Pat. No. 3,951,853 discloses defoamer compositions containing solid particles of an amide suspended in an organic liquid. The amide may be prepared by the reaction of a fatty acid with a primary polyamine, such as ethylene diamine, diethylene triamine, tetraethylene pentamine or hexamethylene diamine. A mixture of the ethylene diamine diamide of stearic acid and the ethylene diamine diamide of 12-hydroxystearic acid is used in the examples.

SUMMARY OF THE INVENTION

The present invention relates to a liquid detergent composition comprising: an amide which is a reaction product of an aliphatic polyamine with two, three or four molecules selected from fully saturated hydroxyl alkyl acids which comprise an alkyl group having from 16 to 20 carbons, wherein the polyamine comprises at least one primary amino group for each saturated hydroxyl alkyl acid; and a surfactant; wherein the detergent composition has a pH of greater than 6.

The present invention further relates to a unit dose article comprising one or more compartments, the one or more compartments formed by water-soluble film which fully encloses one or more inner volumes, wherein the unit dose article comprises a first liquid detergent composition, the first liquid detergent composition comprising a surfactant, and wherein the unit dose article further comprises an amide which is a reaction product of an aliphatic polyamine with two, three or four molecules selected from fully saturated hydroxyl alkyl acids which comprise an alkyl group having from 16 to 20 carbons, wherein the polyamine comprises at least one primary amino group for each saturated hydroxyl alkyl acid.

The present invention further relates to a process for making a detergent composition, comprising the steps of: providing a structuring or thickening premix comprising: from 2 to 10% by weight of an amide which is a reaction product of an aliphatic polyamine with two or three molecules selected from fully saturated hydroxyl alkyl acids which comprise an alkyl group having from 16 to 20 carbons, wherein the polyamine comprises at least one primary amino group for each saturated hydroxyl alkyl acid; from 8 to 24% by weight of a surfactant; an alkali agent, and solvent; wherein the structuring or thickening premix has a pH of greater than 6; and adding the structuring or thickening premix to a composition comprising a solvent and a surfactant.

DETAILED DESCRIPTION OF THE INVENTION

Amides which are a reaction product of the aliphatic polyamine with two, three or four molecules selected from fully saturated hydroxyl alkyl acids which comprise an alkyl group having from 16 to 20 carbons, wherein the polyamine comprises at least one primary amino group for each saturated hydroxyl alkyl acid, have been found to structure liquid detergent compositions, by forming a structuring network in the liquid detergent composition. In addition, the structuring network formed by such amides have also been found to be highly resistant to degradation by hydrolysing ingredients of use in liquid detergent compositions, including lipase.

Such amides provide a high dynamic yield stress, and are hence also highly effective at suspending particulates or droplets, such as particles, microcapsules, core-shell capsules, droplets, and mixtures thereof in liquid detergent compositions.

As defined herein, "essentially free of" a component means that the component is present at a level of less than 5%, preferably less than 2% by weight of the respective premix or composition. Most preferably, "essentially free of" a component means that no amount of that component is present in the respective premix, or composition.

As defined herein, "stable" means that no visible phase separation is observed for a composition kept at 25° C. for a period of at least two weeks, preferably at least four weeks, more preferably at least a month or even more preferably at least four months, as measured using the Floc Formation Test, described in USPA 2008/0263780 A1.

All percentages, ratios and proportions used herein are by weight percent of the respective premix or composition, unless otherwise specified. All average values are calculated "by weight" of the respective premix, composition, or components thereof, unless otherwise expressly indicated.

Unless otherwise noted, all component, premix, or composition levels are in reference to the active portion of that component, premix, or composition, and are exclusive of impurities, for example, residual solvents or by-products, which may be present in commercially available sources of such components or compositions.

All measurements are performed at 25° C. unless otherwise specified.

The Detergent Composition:

Suitable liquid detergent compositions include: products for treating fabrics, including laundry detergent compositions and rinse additives; hard surface cleaners including dishwashing compositions, floor cleaners, and toilet bowl cleaners. The aqueous structuring premix of use in the present invention is particularly suited for liquid detergent compositions. Such liquid detergent compositions comprise sufficient detersive surfactant, so as to provide a noticeable cleaning benefit. Most preferred are liquid laundry detergent compositions, which are capable of cleaning a fabric, such as in a domestic washing machine.

As used herein, "liquid detergent composition" refers to any composition comprising a liquid capable of wetting and treating a substrate, such as fabric or hard surface. Liquid detergent compositions are more readily dispersible, and can more uniformly coat the surface to be treated, without the need to first dissolve the composition, as is the case with solid compositions. Liquid detergent compositions can flow at 25° C., and include compositions that have an almost water-like viscosity, but also include "gel" compositions that flow slowly and hold their shape for several seconds or even minutes.

A suitable liquid detergent composition can include solids or gases in suitably subdivided form, but the overall composition excludes product forms which are non-liquid overall, such as tablets or granules. The liquid detergent compositions preferably have densities in the range from of 0.9 to 1.3 grams per cubic centimeter, more preferably from 1.00 to 1.10 grams per cubic centimeter, excluding any solid additives but including any bubbles, if present.

The liquid detergent composition comprises an amide thickener or structurant, and a surfactant. In addition, the detergent composition has a pH of greater than 6, preferably from 7 to 9, more preferably from 7.6 to 8.4, measured at 25° C.

Preferably, the liquid detergent composition can comprise from 1% to 95% by weight of water, organic solvent, and mixtures thereof. When used, the organic solvent preferably has no amino-functionality. For concentrated liquid detergent compositions, the composition preferably comprises from 15% to 70%, more preferably from 20% to 50%, most preferably from 25% to 45% by weight of water, organic solvent, and mixtures thereof. When used, the organic solvent preferably has no amino-functionality. Alternatively, the liquid detergent composition may be a low water liquid detergent composition. Such low water liquid detergent compositions can comprise less than 20%, preferably less than 15%, more preferably less than 10% by weight of water.

The liquid detergent composition of the present invention may comprise from 2% to 40%, more preferably from 5% to 25% by weight of a organic solvent.

Liquid detergent compositions comprise a surfactant, to provide a detergency benefit. The liquid detergent compositions of the present invention may comprise from 1% to 80%, preferably from 3% to 70%, more preferably from 5% to 60%, even more preferably from 10% to 50%, most preferably from 15% to 45% by weight of a detersive surfactant. Suitable surfactants include detersive surfactants which can be selected from the group consisting of: anionic surfactant, nonionic surfactant and mixtures thereof. Where both anionic and nonionic surfactants are present, the preferred weight ratio of anionic to nonionic surfactant is from 100:0 (i.e. no nonionic surfactant) to 5:95, more preferably from 99:1 to 1:4, most preferably from 5:1 to 1.5:1.

The liquid detergent compositions of the present invention preferably comprise from 1 to 50%, more preferably from 5 to 40%, most preferably from 10 to 30% by weight of one or more anionic surfactants. Preferred anionic surfactants are selected from the group consisting of: C11-C18 alkyl benzene sulphonates, C10-C20 branched-chain and random alkyl sulphates, C10-C18 alkyl ethoxy sulphates, mid-chain branched alkyl sulphates, mid-chain branched alkyl alkoxy sulphates, C10-C18 alkyl alkoxy carboxylates comprising 1-5 ethoxy units, modified alkylbenzene sulphonate, C12-C20 methyl ester sulphonate, C10-C18 alpha-olefin sulphonate, C6-C20 sulphosuccinates, and mixtures thereof. However, by nature, every anionic surfactant known in the art of detergent compositions may be used, such as those disclosed in "Surfactant Science Series", Vol. 7, edited by W. M. Linfield, Marcel Dekker. The detergent compositions preferably comprise at least one sulphonic acid surfactant, such as a linear alkyl benzene sulphonic acid, or the water-soluble salt form of the acid.

The detergent compositions of the present invention preferably comprise up to 30%, more preferably from 1 to 15%, most preferably from 2 to 10% by weight of one or more nonionic surfactants. Suitable nonionic surfactants include, but are not limited to C12-C18 alkyl ethoxylates ("AE") including the so-called narrow peaked alkyl ethoxylates, C6-C12 alkyl phenol alkoxylates (especially ethoxylates and mixed ethoxy/propoxy), block alkylene oxide condensate of C6-C12 alkyl phenols, alkylene oxide condensates of C8-C22 alkanols and ethylene oxide/propylene oxide block polymers (Pluronic®-BASF Corp.), as well as semi polar nonionics (e.g., amine oxides and phosphine oxides). An extensive disclosure of suitable nonionic surfactants can be found in U.S. Pat. No. 3,929,678.

The liquid detergent composition can comprise a lipase enzyme. The liquid detergent composition can comprise lipase enzyme at a level by weight of from 0.00001 to 5%, preferably from 0.0001 to 0.5%, more preferably from 0.001 to 0.2%. Suitable lipases include those of bacterial or fungal origin. Chemically modified or protein engineered mutants are included. Examples of useful lipases include lipases from *Humicola* (synonym *Thermomyces*), e.g., from *H. lanuginosa* (*T. lanuginosus*) as described in EP 258 068 and EP 305 216 or from *H. insolens* as described in WO 96/13580, a *Pseudomonas* lipase, e.g., from *P. alcaligenes* or *P. pseudoalcaligenes* (EP 218 272), *P. cepacia* (EP 331 376), *P. stutzeri* (GB 1,372,034), *P. fluorescens, Pseudomonas* sp. strain SD 705 (WO 95/06720 and WO 96/27002), *P. wisconsinensis* (WO 96/12012), a *Bacillus* lipase, e.g., from *B. subtilis* (Dartois et al. (1993), Biochemica et Biophysica Acta, 1131, 253-360), *B. stearothermophilus* (JP 64/744992) or *B. pumilus* (WO 91/16422).

The lipase can be of bacterial origin. For instance, the lipase can be selected from: (a) lipase having at least 60%, preferably at least 65%, or at least 70%, or at least 75%, or at least 80%, or at least 85%, or at least 90%, or at least 95%, or at least 99% identity with SriII; (b) lipase having at least 60%, preferably at least 65%, or at least 70%, or at least 75%, or at least 80%, or at least 85%, or at least 90%, or at least 95%, or at least 99% identity with ScoIIA; (c) lipase having at least 60%, preferably at least 65%, or at least 70%, or at least 75%, or at least 80%, or at least 85%, or at least 90%, or at least 95%, or at least 99% identity with ScoIIB; and (d) lipase having at least 60%, preferably at least 65%, or at least 70%, or at least 75%, or at least 80%, or at least 85%, or at least 90%, or at least 95%, or at least 99% identity with Cern.

SriII is from *Streptomyces rimosus*. ScoIIA is from *Streptomyces coelicolor*. ScoIB is also from *Streptomyces coelicolor*. Cern is from *Corynebacterium efficiens*.

The lipase may be a "first cycle lipase" such as those described in U.S. Pat. No. 6,939,702 and US PA 2009/0217464. In one aspect, the lipase is a first-wash lipase, preferably a variant of the wild-type lipase from *Thermomyces lanuginosus* comprising T231R and N233R mutations. The wild-type sequence is the 269 amino acids (amino acids 23-291) of the Swissprot accession number Swiss-Prot 059952 (derived from *Thermomyces lanuginosus* (*Humicola lanuginosa*)).

Preferred lipases would include those sold under the tradenames Lipex® including Lipex® Evity®, Lipolex® and Lipoclean® by Novozymes, Bagsvaerd, Denmark.

The composition can comprise a variant of *Thermomyces lanuginosa* lipase having >90% identity with the wild type amino acid and comprising substitution(s) at T231 and/or N233, preferably T231R and/or N233R (herein: "first wash lipase").

The lipase can be at least partially, preferably fully encapsulated. Even when the lipase is encapsulated, residual amounts remain present on the surface of the capsule and also "free" lipase typically remains present. This is both because of the methods used to make the capsules, but also because leakage of the lipase enzyme from the capsule occurs with time. As such, even when encapsulated lipase is used, the use of the amides, as described herein, provides improved viscosity and structuring stability. Such encapsulated lipases, and methods of using them, are described in greater detail in WO 2015/144784 A1.

The composition preferably comprises additional enzyme in addition to lipase. Preferably, the composition comprises enzyme at a level by weight of from 0.00001 to 10%, preferably from 0.0001 to 5%, more preferably from 0.001 to 2%. It may be preferred for the composition to comprise at least a ternary enzyme system selected from protease, amylase, lipase and/or cellulase.

The liquid detergent composition may also include conventional detergent ingredients selected from the group consisting of: additional surfactants selected from amphoteric, zwitterionic, cationic surfactant, and mixtures thereof; enzyme stabilizers; amphiphilic alkoxylated grease cleaning polymers; clay soil cleaning polymers; soil release polymers; soil suspending polymers; bleaching systems; optical brighteners; hueing dyes; particulates; perfume and other odour control agents, including perfume delivery systems; hydrotropes; suds suppressors; fabric care perfumes; pH adjusting agents; dye transfer inhibiting agents; preservatives; non-fabric substantive dyes; and mixtures thereof.

The amides of use in the present invention are particularly effective at stabilizing particulates since they provide improved low shear viscosity. Suitable particulates can be selected from the group consisting of: particles, microcapsules, core-shell capsules, droplets, and mixtures thereof.

Microcapsules are typically formed by at least partially, preferably fully, surrounding a benefit agent with a wall material. Suitable benefit agents can be selected from the group consisting of: a perfume, a silicone, a biocontrol agent, an antimicrobial agent, a heating or cooling agent, a drug, a sun screen, a skin benefit agents such as paraffin and petrolatum, hueing dyes, enzymes, brighteners, a malodor control technology, and mixtures thereof. Preferably, the microcapsule is a perfume microcapsule, where said benefit agent comprises one or more perfume raw materials.

The microcapsule wall material may comprise: melamine, polyacrylamide, silicones, silica, polystyrene, polyurea, polyurethanes, polyacrylate based materials, polyacrylate esters based materials, gelatin, styrene malic anhydride, polyamides, aromatic alcohols, polyvinyl alcohol, resorcinol-based materials, poly-isocyanate-based materials, acetals (such as 1,3,5-triol-benzene-gluteraldehyde and 1,3,5-triol-benzene melamine), starch, cellulose acetate phthalate and mixtures thereof.

Suitable melamine wall material comprises melamine crosslinked with formaldehyde, melamine-dimethoxyethanol crosslinked with formaldehyde, and mixtures thereof.

Suitable polyacrylate wall material comprises one or more multifunctional acrylate moieties; preferably said multifunctional acrylate moiety being selected from the group consisting of tri-functional acrylate, tetra-functional acrylate, penta-functional acrylate, hexa-functional acrylate, hepta-functional acrylate and mixtures thereof; and optionally a polyacrylate that comprises a moiety selected from the group consisting of an amine acrylate moiety, methacrylate moiety, a carboxylic acid acrylate moiety, carboxylic acid methacrylate moiety and combinations thereof.

The perfume microcapsule may be coated with a deposition aid, a cationic polymer, a non-ionic polymer, an anionic polymer, or mixtures thereof. Suitable polymers may be selected from the group consisting of: polyvinylformaldehyde, partially hydroxylated polyvinylformaldehyde, polyvinylamine, polyethyleneimine, ethoxylated polyethyleneimine, polyvinylalcohol, polyacrylates, chitosan and chitosan derivatives and combinations thereof.

Preferably, the perfume microcapsules have a volume weighted mean particle size from 0.1 microns to 100 microns, preferably from 0.5 microns to 60 microns. The microcapsule walls preferably have a thickness of from 0.05 microns to 10 microns, more preferably from 0.05 microns to 1 micron. Typically, the microcapsule core comprises from 50% to 95% by weight of the benefit agent.

Especially where the composition comprises microcapsules having a shell formed at least partially from formaldehyde, the liquid detergent composition can additionally comprise one or more sulfur-based or non-sulfur-based formaldehyde scavengers.

Microcapsules can be added at a level of from 0.01% to 10%, more preferably from 0.1% to 2%, even more preferably from 0.15% to 0.75% of the encapsulated active, by weight of the liquid detergent composition. In a preferred embodiment, the microcapsules are perfume microcapsules, in which the encapsulated active is a perfume. Such perfume microcapsules release the encapsulated perfume upon breakage, for instance, when the treated substrate is rubbed.

Suitable droplets can be selected from the group consisting of: silicones, oils such as perfumes, cleaning polymers, and mixtures thereof.

Preferred oils are perfumes, which provide an odour benefit to the liquid detergent composition, or to substrates treated with the liquid detergent composition. When added, such perfumes are added at a level of from 0.05% to 5%, more preferably from 0.3% to 3%, even more preferably from 0.6% to 2% by weight of the liquid detergent composition.

Suitable particles include mica, and other powdered insoluble materials. The particles can have volume weighted mean particle size of less than 50 μm. Most preferably the particles have a particle size distribution of from 0.1 μm to 50 μm, more preferably from 0.5 μm to 25 μm and most preferably from 1 μm to 20 μm.

The Thickening or Structuring Amide:

Suitable amides, for use as a thickener or structurant in the compositions of the present invention, are a reaction product of an aliphatic polyamine with two, three or four molecules selected from fully saturated hydroxyl alkyl acids which comprise an alkyl group having from 16 to 20 carbons, wherein the polyamine comprises at least one primary amino group for each saturated hydroxyl alkyl acid.

The amide thickener or structurant is preferably added at a level which imparts a shear thinning viscosity profile to the liquid detergent composition, independently from, or extrinsic from, any structuring effect of the detersive surfactants of the composition.

The liquid detergent composition preferably has a pouring viscosity of from 50 cps to 20,000 cps, more preferably from 200 cps to 10,000 cps, most preferably from 500 cps to 7,000 cps. The pouring viscosity is measured at a shear rate of 20 sec-1, which is a shear rate that the liquid detergent composition is typically exposed to during pouring.

For improved suspension and phase stability, the amide thickener or structurant is preferably added at a level which imparts a dynamic yield stress of from 0.01 to 10.0 Pa, preferably from 0.05 to 5.0 Pa, more preferably from 0.08 to 2.0 Pa.

The detergent composition can comprise the amide at a level by weight of from 0.001 to 10%, preferably from 0.01 to 5%, more preferably from 0.05 to 3%, most preferably 0.1 to 1.2% of the detergent composition Preferably, the aliphatic polyamine comprises one primary amino group for each saturated hydroxyl alkyl acid. The aliphatic polyamine can comprise additionally at least one secondary and/or tertiary amino group.

The fully saturated hydroxyl alkyl acids comprises an alkyl group having from 16 to 20 carbons. Particularly preferred are fully saturated hydroxyl alkyl acids selected from the group consisting of: 12-hydroxyoctadecanoic acid, 12-hydroxynonadecanoic acid, β-hydroxynonadecanoic acid, 12-hydroxyeicosanoic acid, 10-hydroxyhexadecanoic acid, 10-hydroxyoctadecanoic acid, and mixtures thereof. 12-hydroxyoctadecanoic acid is most preferred.

The amide can have the structure of formula (I):

$$R^1(CO)NH(CH_2)_x[NR^2(CH_2)_x]_yNH(CO)R^1 \quad (I)$$

wherein:

$R^1$ is a fully saturated alkyl chain containing at least 1 hydroxyl group and from 16 to 20 carbons, preferably $R^1$ is a fully saturated alkyl chain having 17 carbons containing 1 hydroxyl group, more preferably $R^1(CO)$ is 12-hydroxyoctadecanoyl;

groups $R^2$ are independently of one another hydrogen, methyl or $(CH_2)_xNH(CO)R^1$ with the proviso that no more than two, preferably no more than 1, group $R^2$ is $(CH_2)_xNH(CO)R^1$, preferably, $R^2$ is H or $(CH_2)_xNH(CO)R^1$;

x=2 or 3; and y=1, 2 or 3, preferably y=1 or 2, more preferably y=1.

For improved structuring, in the structure of formula (I), $R^2$ is hydrogen or $(CH_2)_xNH(CO)R^1$. Structuring is also improved when the amide is symmetric.

Alternatively, the amide can have the structure of formula (II):

$$R^3(CO)NH(CH_2)_a(CHR^4)_b(CH_2)_aNH(CO)R^3 \quad (II)$$

wherein $R^3$ is a fully saturated alkyl chain containing at least 1 hydroxyl group and from 16 to 20 carbons, preferably $R^3$ is a fully saturated alkyl chain having 17 carbons containing 1 hydroxyl group, more preferably $R^3(CO)$ is 12-hydroxyoctadecanoyl;

$R^4$ is H, methyl or $NH(CO)R^3$, preferably $R^4$ is $NH(CO)R^3$;

a is 1 or 2, preferably 1;

b is 0, 1 or 2, preferably 0.

Preferably, the fully saturated hydroxyl alkyl acids are bonded to the primary amino groups of the polyamine.

The amides of use in the invention can be prepared by reacting the fully saturated hydroxyl alkyl acids or fully saturated hydroxyl alkyl esters with the aliphatic polyamine, using known methods for the amidation of a carboxylic acid or its ester. Where the fully saturated hydroxyl alkyl acids is 12-hydroxyoctadecanoic acid, the fully saturated hydroxyl alkyl ester may be hydrogenated castor oil, i.e. the 12-hydroxyoctadecanoic acid triester of glycerol. The molar ratio of the fully saturated hydroxyl alkyl acid or fully saturated hydroxyl alkyl ester to the aliphatic polyamine is preferably about 2:1 for aliphatic polyamines containing two primary amino groups and from 2:1 to 3:1 for aliphatic polyamines containing three primary amino groups. Suitable aliphatic polyamines comprising two, three or four primary amino groups and optionally at least one secondary and/or tertiary amino group are commercially available. Preferred aliphatic polyamines comprise two or three primary amino groups.

The amides are particularly useful as thickeners for aqueous compositions, comprising water.

They are also particularly useful as thickeners for liquid detergents containing a lipase enzyme because they are not degraded by lipase enzymes or other hydrolysing ingredients. Where the amide comprises at least one secondary and/or tertiary amino group, they can be more easily processed to a thickened composition compared to diamides of an aliphatic diamine containing no secondary or tertiary amino group, such as the diamides of 12-hydroxyoctadecanoic acid of ethylenediamine or hexamethylenediamine Compared to prior art monoamides of fully saturated hydroxyl alkyl acids, such as monoamides of 12-hydroxyoctadecanoic acid, the amides of use in compositions of the invention provide better thickening in aqueous compositions, in particular in liquid detergents. A particular advantage of the amides of use in the invention is that their thickening effect in an aqueous composition can be altered by adjusting the acidity of the composition, which allows for reducing the thickening effect during the preparation and processing of the composition and increasing it in the final thickened product by adjusting the acidity of the product.

Suitable commercially available polyamines for making amides of formula (I) are diethylenetriamine, triethylenetetraamine, tetraethylenepentaamine, bis-(2-aminoethyl)-methylamine, bis-(2-aminoethyl)-amine, dipropylenetriamine, tripropylenetetraamine and bis-(3-aminopropyl)-methylamine.

More preferred are diamides of formula (I), where $R^2$ is hydrogen and x=2. Such diamides can be prepared from diethylenetriamine, triethylenetetraamine and tetraethylenepentaamine Most preferred is the diamide of formula (I), where $R^2$ is hydrogen, x=2 and y=1, which can be prepared from diethylenetriamine.

A combination of thickening or structuring amides can be used. Preferably, at least 80% by weight of said amides have the structure of formula (I) as defined above, more preferably the structure of formula (I) where $R^2$ is hydrogen and x=2, and most preferably the structure of formula (I) where $R^2$ is hydrogen, x=2 and y=1. A combination of amides of formula (I) and formula (II) can also be used.

One or more amides, of use in compositions of the present invention, can be combined with other thickeners or structurants, such as polymeric thickening or structuring agents. Suitable polymeric thickening or structuring agents include naturally derived and/or synthetic polymeric structurants. Suitable naturally derived polymeric thickeners and structurants include: hydroxyethyl cellulose, hydrophobically modified hydroxyethyl cellulose, carboxymethyl cellulose, polysaccharide derivatives and mixtures thereof (such as xanthan gum). Suitable synthetic polymeric thickeners and structurants include: polycarboxylates, polyacrylates, hydrophobically modified ethoxylated urethanes, hydrophobically modified non-ionic polyols and mixtures thereof. The polyacrylate can be a copolymer of unsaturated mono- or di-carbonic acid and C1-C30 alkyl ester of the (meth) acrylic acid. Such thickeners and structurants can be added at a level of from 0.01 to 5% by weight of the liquid detergent composition.

The thickening or structuring amide is typically a solid, having a melting range of from 50 to 150° C., preferably from 75 to 120° C., more preferably from 80 to 115° C., most preferably from 85 to 110° C. Solid compositions may have any physical shape, such as blocks, bars, flakes, granules or powder, with flakes and powders being preferred. Such solid compositions typically comprise little or no water. As such, the solid composition may comprise from 0 to 10% by weight water. Preferably, the solid composition comprises less than 5% by weight water. When at least one of groups $R^2$ is hydrogen, the composition preferably comprises from 0.2 to 10% by weight water, more preferably from 0.2 to 5% by weight water.

The solid composition may be prepared by mixing one or more of said amides with one or more of diluents and optionally water, preferably with heating to a temperature where the resulting composition will be molten.

The solid composition can comprise from 5 to 50% by weight of one or more diluents selected from methanol, ethanol, 1 propanol, 2 propanol, ethylene glycol, propylene glycol, diethylene glycol, dipropylene glycol, oligoethylene glycols with a molecular weight of less than 400 g/mol, oligopropylene glycols with a molecular weight of less than 400 g/mol, monoethers of said glycols with C1-3 alcohols, and glycerol. The solid composition preferably comprises from 10 to 30% by weight of said diluents. The solid composition also preferably comprises at least 2% by weight of glycerol. In a preferred embodiment, said diluents comprise at least 80% by weight of propylene glycol, dipropylene glycol or a mixture of both. In a further preferred embodiment, said diluents comprise at least 80% by weight of glycerol. Solid compositions containing a diluent in addition to the amide can be more easily dispersed in water or in an aqueous composition than the pure amide, using standard stirred tank equipment. The use of propylene glycol, dipropylene glycol or glycerol as diluents provides solid compositions having a flash point of greater than 100° C. that can be dispersed in water or in an aqueous composition without a risk of forming flammable vapours. Solid compositions containing glycerol as a diluent have the advantage that they can be prepared directly by reacting the fully saturated hydroxyl alkyl acid ester, such as 12 hydroxyoctadecanoic acid ester, with the aliphatic polyamine without the need for removing a solvent.

Examples of suitable thickening or structuring amides, of use in the compositions of the present invention, are given in Table 1:

TABLE 1

| IUPAC Name | Structure |
|---|---|
| N,N'-((ethane-1,2-diylbis(azanediyl))bis(ethane-2,1-diyl))bis(12-hydroxyoctadecanamide) | 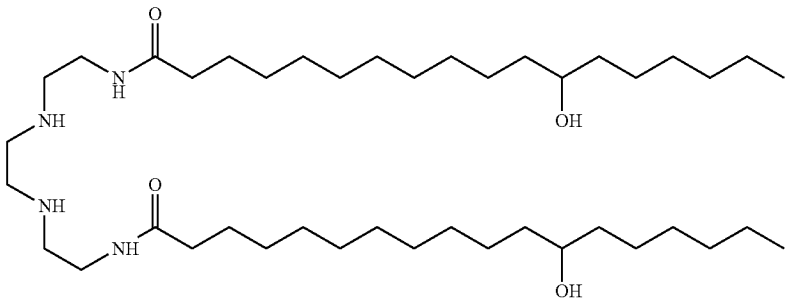 |
| N,N'-(ethane-1,2-diyl)bis(12-hydroxyoctadecanamide) | 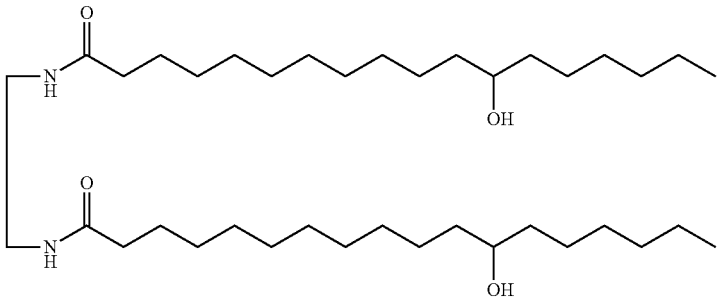 |

TABLE 1-continued
| IUPAC Name | Structure |
|---|---|
| N,N'-(ethane-1,2-diyl)bis(12-hydroxynonadecanamide) | 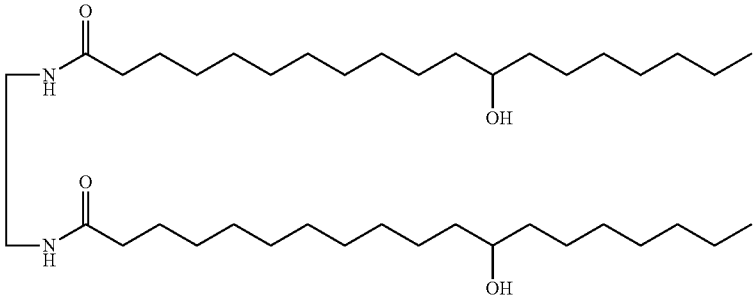 |
| N,N',N''-1,2,3-propanetriyltris(12-hydroxynonadecanamide) | 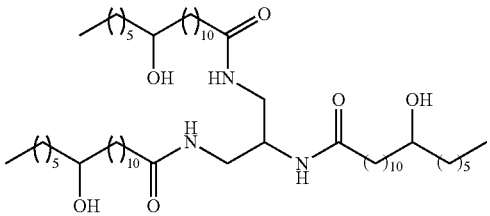 |
| N,N',N'',N'''-1,2,3,4-butanetetrayltetrakis(12-hydroxynonadecanamide) | 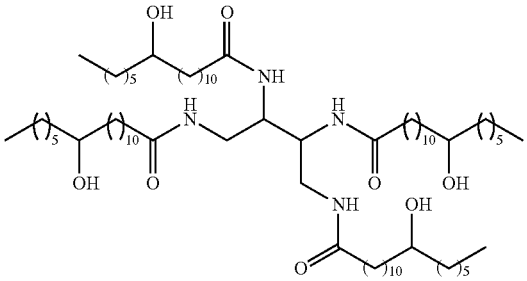 |
| N,N'-(((azanediylbis(ethane-2,1-diyl))bis(azanediyl))bis(ethane-2,1-diyl))bis(12-hydroxyoctadecanamide) | 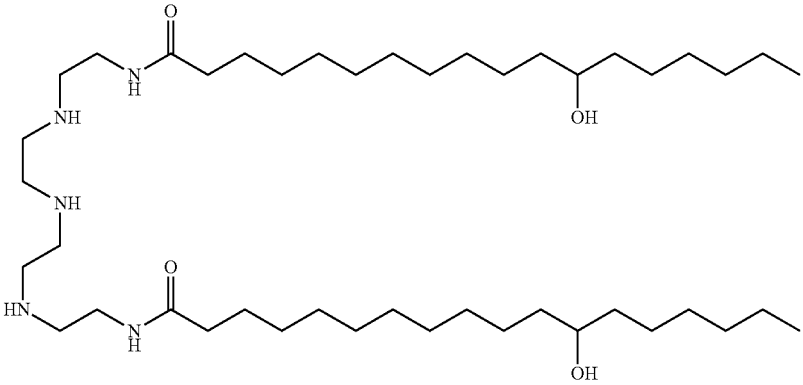 |
| N,N'-((methylazanediyl)bis(propane-3,1-diyl))bis(12-hydroxyoctadecanamide) | 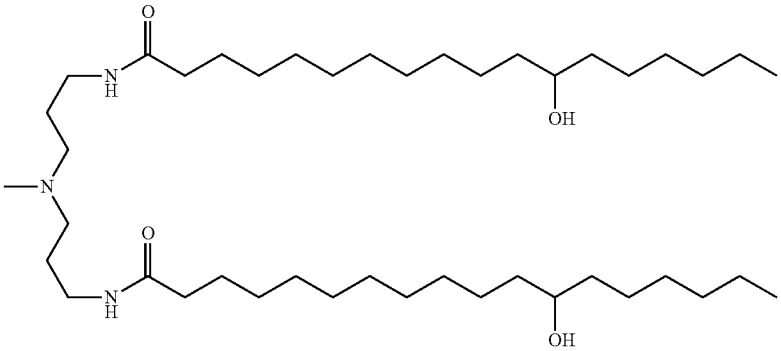 |

TABLE 1-continued

| IUPAC Name | Structure |
|---|---|
| N,N',N''-(nitrilotris(ethane-2,1-diyl))tris(12-hydroxyoctadecanamide) | 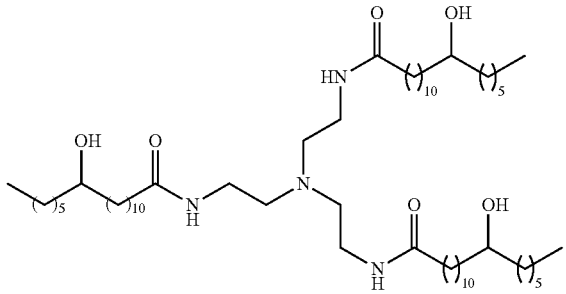 |
| N,N'-(azanediylbis(ethane-2,1-diyl))bis(12-hydroxyoctadecanamide) | 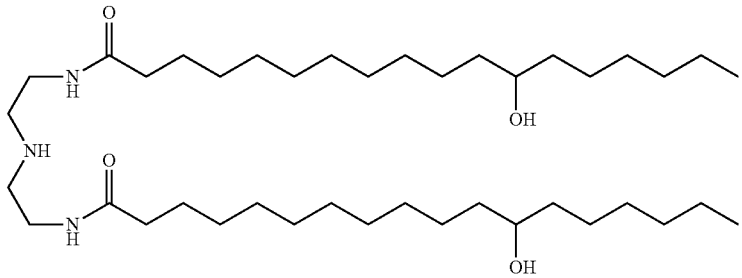 |

Preferred amides can be selected from the group consisting of: N,N'-((ethane-1,2-diylbis(azanediyl))bis(ethane-2,1-diyl))bis(12-hydroxyoctadecanamide), N,N'-(ethane-1,2-diyl)bis(12-hydroxyoctadecanamide), N,N'-(ethane-1,2-diyl)bis(12-hydroxynonadecanamide), N,N',N''-1,2,3-propanetriyltris(12-hydroxynonadecanamide), 1,2,3,4-butanetetrayltetrakis(12-hydroxynonadecanamide), N,N'-(((azanediylbis(ethane-2,1-diyl))bis(azanediyl))bis(ethane-2,1-diyl))bis(12-hydroxyoctadecanamide), N,N'-((methylazanediyl)bis(propane-3,1-diyl))bis(12-hydroxyoctadecanamide), N,N',N''-(nitrilotris(ethane-2,1-diyl))tris(12-hydroxyoctadecanamide), N,N'-(azanediylbis(ethane-2,1-diyl))bis(12-hydroxyoctadecanamide) and mixtures thereof.

More preferred amides can be selected from the group consisting of: N,N'-((ethane-1,2-diylbis(azanediyl))bis(ethane-2,1-diyl))bis(12-hydroxyoctadecanamide), N,N'-(((azanediylbis(ethane-2,1-diyl))bis(azanediyl))bis(ethane-2,1-diyl))bis(12-hydroxyoctadecanamide), N,N'-((methylazanediyl)bis(propane-3,1-diyl))bis(12-hydroxyoctadecanamide), N,N',N''-(nitrilotris(ethane-2,1-diyl))tris(12-hydroxyoctadecanamide), N,N'-(azanediylbis(ethane-2,1-diyl))bis(12-hydroxyoctadecanamide) and mixtures thereof.

N,N'-(azanediylbis(ethane-2,1-diyl))bis(12-hydroxyoctadecanamide) is the preferred thickening or structuring amide.

Preferably, the thickening or structuring amide is prepared by a condensation method comprising a step of heating a starting mixture comprising a fully saturated hydroxyl alkyl acid and one or more aliphatic polyamines, each polyamine comprising at least two primary amino groups and optionally at least one secondary and/or tertiary amino group. In a preferred embodiment, the thickening or structuring amide is prepared by a condensation method comprising a step of heating a starting mixture comprising a fully saturated hydroxyl alkyl ester, such as hydrogenated castor oil, and one or more aliphatic polyamines, each polyamine comprising at least two primary amino groups and optionally at least one secondary and/or tertiary amino group, to a temperature of from 120 to 160° C. to provide a reaction mixture, wherein the fully saturated hydroxyl alkyl acid or its ester and said amines are used in amounts providing a molar ratio of fully saturated hydroxyl alkyl acid or its ester groups to primary amino groups of said amines of from 0.9 to 1.1, and a step of adding one or more diluents selected from methanol, ethanol, 1-propanol, 2-propanol, ethylene glycol, propylene glycol, diethylene glycol, dipropylene glycol, oligoethylene glycols with a molecular weight of less than 400 g/mol, oligopropylene glycols with a molecular weight of less than 400 g/mol, and monoethers of said glycols with $C_{1-3}$ alcohols in an amount of from 10 to 100% by weight, based on the combined amount of fully saturated hydroxyl alkyl ester and said amines, before or after said heating step. Preferably, the step of adding one or more diluents is carried out after said heating step. The diluents are preferably propylene glycol, dipropylene glycol or a mixture of both.

Preferably, a polyamine having a structure of formula (III):

$$H_2N(CH_2)_x[NR^2(CH_2)_x]_yNH_2 \quad \text{(III)}$$

is used in the method of the invention, wherein groups $R^2$ are independently of one another hydrogen, methyl or $(CH_2)_xNH_2$ with the proviso that no more than one group $R^2$ is $(CH_2)_xNH_2$, x=2 or 3, and y=1, 2 or 3. More preferred are polyamines having the structure of formula (III) where $R^2$ is hydrogen and x=2, and most preferred are polyamines having the structure of formula (III) where $R^2$ is hydrogen, x=2 and y=1.

The step of heating a mixture comprising fully saturated hydroxyl alkyl acid or its ester and one or more aliphatic polyamines is preferably carried out until more than 90% of the fully saturated hydroxyl alkyl acid or its ester has reacted to form an amide. Conversion of the fully saturated hydroxyl alkyl acid or its ester to the amide can be determined by monitoring the ester number of the reaction mixture. The step of heating a mixture comprising fully saturated hydroxyl alkyl acid or its ester and one or more aliphatic polyamines is typically carried out for a time of 4 to 10 h, reaction times at the lower end of this range being used at the upper end of the temperature range and reaction times at the upper end of this range being used at the lower end of the temperature range. The step of heating a mixture comprising fully saturated hydroxyl alkyl acid or its ester and one or more aliphatic polyamines is preferably carried out with stirring.

When a polyamine is used wherein at least one of groups $R^2$ is hydrogen, the method of the invention preferably comprises the additional steps of adding water to said reaction mixture, optionally comprising said diluents, in an amount of from 1 to 5% by weight, based on the combined amount of fully saturated hydroxyl alkyl acid or its ester and said amines, and maintaining the resulting mixture at a temperature of from 100 to 130° C. for a period of from 1 to 3 h.

These additional steps convert imidazoline or other cyclic amidine by-products, formed in the step of heating the mixture comprising fully saturated hydroxyl alkyl acid or its ester and an aliphatic polyamine, to the desired amide, which improves the reaction yield of amide and provides improved purity.

The amides of use in the present invention can be formulated into structuring or thickening premixes. Such structuring or thickening premixes comprise by weight of from 2 to 10%, preferably from 2.5 to 8%, more preferably from 3 to 6% of an amide which is a reaction product of an aliphatic polyamine with two, three or four molecules selected from fully saturated hydroxyl alkyl acids which comprise an alkyl group having from 16 to 20 carbons, preferably 18 carbon atoms, wherein the polyamine comprises at least one primary amino group for each saturated hydroxyl alkyl acid; from 8 to 24%, preferably from 10 to 20%, more preferably from 12 to 18% by weight of a surfactant selected from the group consisting of anionic surfactant, nonionic surfactant, and mixtures thereof; an alkali agent, and solvent. For improved structuring or thickening, the alkali agent is added at a level to provide a pH of greater than 6.0 or 6.5, preferably from 7 to 9, more preferably from 7.6 to 8.4.

Suitable alkali agents can be selected from the group consisting of: sodium hydroxide, C1-C5 ethanolamines, and mixtures thereof. Preferred alkali agents are selected from the group consisting of: monoethanolamine, diethanolamine, triethanolamine, sodium hydroxide, and mixtures thereof. Monoethanolamine is most preferred.

The surfactant can be selected from the group comprising anionic, cationic, non-ionic, zwitterionic surfactants, or mixtures thereof, though anionic, nonionic or combinations of anionic and nonionic surfactants are preferred. Preferably, the surfactant is an anionic surfactant. Suitable anionic surfactants can be selected from the group consisting of: sodium linear alkylbenzene sulphonates, potassium linear alkylbenzene sulphonates, and acidic form of linear alkylbenzene sulphonates (HLAS), in which the average number of carbon atoms in the alkyl group is from 11 to 16.

Any suitable solvent can be used, though the premix is preferably an aqueous premix. That is, the premix comprises water. The premix can comprise water at a level greater that 10% by weight of the premix, or at a level of from 10 to 90%, preferably 25 to 85%, more preferably from 40 to 80% by weight of the premix. The solvent can be selected from the group consisting of: water, methanol, ethanol, 1-propanol, 2-propanol, butanol, ethylene glycol, propylene glycol, diethylene glycol, dipropylene glycol, 20 oligoethylene glycols with a molecular weight of less than 400 g/mol, oligopropylene glycols with a molecular weight of less than 400 g/mol, monoethers of said glycols with C1-3 alcohols, and glycerol, and mixtures thereof. More preferably, the solvent comprises water in combination with an organic solvent, preferably selected from the group consisting of: methanol, ethanol, 1-propanol, 2-propanol, ethylene glycol, propylene glycol, diethylene glycol, dipropylene glycol, 20 oligoethylene glycols with a molecular weight of less than 400 g/mol, oligopropylene glycols with a molecular weight of less than 400 g/mol, monoethers of said glycols with C1-3 alcohols, and glycerol, and mixtures thereof. More preferably, the organic solvent is selected from the group consisting of: methanol, ethanol, 1-propanol, 2-propanol, butanol, ethylene glycol, propylene glycol, diethylene glycol, dipropylene glycol and mixtures thereof, most preferably from the group consisting of: methanol, ethanol, butanol, ethylene glycol, propylene glycol, and mixtures thereof. When present, the premix preferably comprises the organic solvent at a level of from 0.2 to 15%, more preferably from 1 to 10%, most preferably from 2 to 8% by weight of the premix.

Where the premix comprises less than 10% by weight of water or even no water, higher levels of organic solvent are preferred. In such low water or non-aqueous premixes, the organic solvent can be added at a level by weight of from 10 to 90%, preferably from 25 to 85%, more preferably from 40 to 80%.

The thickening or structuring premix can be made using a process comprising the steps of:

(a) preparing a first mixture containing the surfactant, the alkali agent and the solvent at a temperature of from 40° C. to 60° C.;

(b) adding the amide to form a second mixture;

(c) heating the second premix to a temperature such that the amide is at least partially, preferably fully melted;

(d) emulsifying the amide in the second mixture;

(e) cooling the second mixture to form the thickening or structuring premix; and (d) optionally, adding a preservative to the thickening or structuring premix.

The solvent of the thickening or structuring premix is preferably water. The solvent of the thickening or structuring premix can comprise water and an organic solvent. Suitable organic solvents can be selected from the group consisting of: methanol, ethanol, 1-propanol, 2-propanol, ethylene glycol, propylene glycol, diethylene glycol, dipropylene glycol, 20 oligoethylene glycols with a molecular weight of less than 400 g/mol, oligopropylene glycols with a molecular weight of less than 400 g/mol, monoethers of said glycols with C1-3 alcohols, and glycerol. Such organic solvent might be added in step (a) or in step (b) together with the amide composition.

In another embodiment, the solvent of the thickening or structuring premix comprises less than 10% by weight of water, preferably less than 5%, even more preferably less than 2% by weight of water, most preferably is essentially free of water.

As mentioned earlier, the amide is a reaction product of an aliphatic polyamine with two, three or four molecules selected from fully saturated hydroxyl alkyl acids which comprise an alkyl group having from 16 to 20 carbons, wherein the polyamine comprises at least one primary amino group for each saturated hydroxyl alkyl acid. The amide can be added to the first mixture in the form of a mixture comprising solvent, in order to reduce the melting point of the amide.

The first mixture can be heated using any suitable means. Alternatively, the first mixture can be prepared using heated solvent, such as water, such that the first mixture is at the desired temperature.

In order to form a second mixture in which the amide has been fully melted, the second mixture is typically heated to a temperature of from 50° C. to 150° C., preferably from 75° C. to 120° C.

The amide can be emulsified in the second mixture using any suitable means. The process to make the emulsion can be a continuous process or a batch process. By 'continuous process' we herein mean continuous flow of the material through the apparatus. By 'batch processes' we herein mean where the process goes through discrete and different steps. The flow of product through the apparatus is interrupted as different stages of the transformation are completed, i.e. discontinuous flow of material. Without being bound by theory, it is believed that the use of a continuous process provides improved control of the emulsion droplet size, as compared to a batch process.

The emulsion can be prepared using any suitable mixing device. The mixing device typically uses mechanical energy to mix the liquids. Suitable mixing devices can include static and dynamic mixer devices. Examples of dynamic mixer devices are homogenizers, rotor-stators, and high shear mixers. The mixing device could be a plurality of mixing devices arranged in series or parallel in order to provide the necessary energy dissipation rate.

When a homogenizer is used, emulsification typically takes place at a speed of from 500 rpm to 10.000 rpm, preferably from 800 rpm to 6.500 rpm, even more preferably from 1.000 rpm to 5.000 rpm. Other suitable emulsification devices may provide same result at much lower speed, such as 50 rpm to 500 rpm, preferably from about 80 rpm to about 300 rpm.

Preferably, the emulsion is formed by combining the ingredients via high energy dispersion, having an energy dissipation rate of from 1×102 W/Kg to 1×107 W/Kg, preferably from 1×103 W/Kg to 5×106 W/Kg, more preferably from 5×104 W/Kg to 1×106 W/Kg.

Without being bound by theory, it is believed that high energy dispersion reduces the emulsion droplet size and increases the thickening and structuring efficacy.

The second mixture can be actively cooled using a heat transfer device, or can be passively cooled by leaving the second mixture in a cooler environment, preferably at or close to the desired final temperature. The second mixture can be cooled in one step. Alternatively, cooling is done in 2 steps: one step comprising fast cooling at a cooling rate from 2° C./min to 20° C./min, preferably from 5° C./min to 10° C./min; another step comprising slow cooling at a cooling rate below 2° C./min, preferably from 0.2° C./min to 2° C./min Slow cooling and fast cooling can be applied in any order. Preferably, slow cooling is used at least in the temperature range of about 20° C. above the crystallization temperature of the amide to about 20° C. below the crystallization temperature of the amide (as measured via DSC of the amide at a cooling rate of 5.00° C./min).

The emulsion can be cooled to the final temperature by any suitable means, such as by passing it through one or more heat exchanger devices. Suitable heat exchanger devices can be selected from the group consisting of: plate and frame heat exchanger, shell and tube heat exchangers, and combinations thereof. The final temperature can be less than 80° C., or from 10° C. to less than 60° C., or from 15° C. to less than 40° C.

When formulated as a structuring or thickening premix, the amide can be added into the unthickened or unstructured liquid detergent composition via simple mixing, even low shear mixing. Any suitable means can be used for incorporating the premix into an unthickened or unstructured liquid composition, including static mixers, and through the use of over-head mixers, such as typically used in batch processes.

Preferably, the thickening or structuring premix is added after the incorporation of ingredients that require high shear mixing. More preferably, the premix is the last ingredient incorporated into the liquid composition. The premix is preferably incorporated into the liquid composition using low shear mixing. Preferably, thickening or structuring premix is incorporated into the liquid composition using average shear rates of less than 1,000 $s^{-1}$, preferably less than 500 $s^{-1}$, more preferably less than 200 $s^{-1}$. The residence time of mixing is preferably less than 60 s, more preferably less than 20 s, more preferably less than 5 s, even more preferably less than 1 s. The shear rate and residence time is calculated according to the methods used for the mixing device, and is usually provided by the manufacturer. For instance, for a static mixer, the average shear rate is calculated using the equation:

$$\dot{\gamma} = \frac{v_{pipe}}{D_{pipe}} * v_f^{-3/2}$$

where:

$v_f$ is the void fraction of the static mixer (provided by the supplier)

$D_{pipe}$ is the internal diameter of the pipe comprising the static mixer elements $v_{pipe}$ is the average velocity of the fluid through a pipe having internal diameter $D_{pipe}$, calculated from the equation:

$$v_{pipe} = \frac{4Q}{\pi D_{pipe}^2}$$

Q is the volume flow rate of the fluid through the static mixer.

For a static mixer, the residence time is calculated using the equation:

$$\text{residence time} = \frac{\pi D_{pipe}^2 v_f L}{4Q}$$

where:

L is the length of the static mixer.

Unit Dose Liquid Detergent Articles:

The amides, of use in the present invention, can also be used to thicken or structure liquid compositions contained within a unit dose article.

Suitable unit dose articles comprise one or more compartments, formed by water-soluble film which fully encloses one or more inner volumes. The unit dose article comprises a first detergent composition. The first detergent composition comprises a surfactant. The unit dose article further comprises an amide which is a reaction product of an aliphatic polyamine with two, three or four molecules selected from fully saturated hydroxyl alkyl acids which comprise an alkyl group having from 16 to 20 carbons, wherein the polyamine comprises at least one primary amino group for each saturated hydroxyl alkyl acid, as described earlier.

The first detergent composition can be a liquid detergent composition. In such cases, the amide can be present in the first liquid detergent composition, in order to provide the desired thickening or structuring. Alternatively, the amide can be present in a second or further compartment of the unit dose article, in order to provide thickening or structuring to a liquid composition contained therein. In preferred embodiments, the compartment comprising the amide also comprises lipase enzyme. In such cases, the amide suspends the lipase in the liquid composition. Both the amide and the lipase can be comprised in the first liquid detergent composition. Alternatively, the lipase and amide can be comprised in a second liquid composition which forms the contents of a second compartment of the unit dose article. As such, at least one of the inner volumes comprises a liquid composition comprising the amide described herein. As mentioned earlier, the lipase enzyme can optionally be encapsulated.

The liquid compositions comprised in the unit dose article, are preferably low water, having less than 20%, preferably less than 15%, more preferably less than 10% by weight of water.

The unit dose article may optionally comprise additional compartments comprising further low water liquid detergent compositions, or solid compositions. A multi-compartment unit dose form may be desirable for such reasons as: separating chemically incompatible ingredients; or where it is desirable for a portion of the ingredients to be released into the wash earlier or later. The unit-dose articles can be formed using any means known in the art.

Unit dose articles, wherein the low water liquid detergent composition is a liquid laundry detergent composition are particularly preferred.

Suitable water soluble films include polymers, copolymers or derivatives thereof. Preferred polymers, copolymers or derivatives thereof are selected from the group consisting of: polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatin, natural gums such as xanthan and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof.

When used for unit dose articles comprising a liquid composition, the thickening or structuring premix is preferably a low water or non-aqueous thickening or structuring premix which comprises less than 10% by weight of water or even no water. However, higher water levels can be used in the premix so long as the liquid detergent composition does not comprise water at a level which dissolves the water soluble film.

Methods:

A) Method of Measuring Dynamic Yield Stress and Viscosity:

Both parameters are measured using an HAAKE MARS from Thermo Scientific using a 60 mm 1° Cone and a gap size of 52 microns (plate in case the product contains particles). The dynamic yield stress can be obtained by measuring flow curve from 10 (1/s) to $10^{-4}$ (1/s) and applying Herschel-Bulkley fit: $\tau=\tau 0+K\gamma n$, where $\tau$ is the shear stress, $\tau 0$ is the dynamic yield stress, and is y the shear rate. K and n are fitting parameters. The high shear viscosity at 20 s-1 and low shear viscosity at 0.5 $s^{-1}$ can be obtained from a logarithmic shear rate sweep from 0.01 $s^{-1}$ to 1200 $s^{-1}$ at 20° C.

B) Method of Measuring pH:

The pH is measured, at 25° C., using a Santarius PT-10P pH meter with gel-filled probe (such as the Toledo probe, part number 52 000 100), calibrated according to the instructions manual.

C) Energy Dissipation Rate:

In a continuous process comprising a static emulsification device, the energy dissipation rate is calculated by measuring the pressure drop over the emulsification device, and multiplying this value by the flow rate, and then dividing by the active volume of the device. In the case where an emulsification is conducted via an external power source, such as a batch tank or high shear mixer, the energy dissipation is calculated via the following Formula 1 (Kowalski, A. J., 2009, Power consumption of in-line rotor-stator devices. Chem. Eng. Proc. 48, 581.);

$$P_f=P_T+P_F+P_L \qquad \text{Formula 1}$$

Wherein $P_T$ is the power required to rotate the rotor against the liquid, $P_F$ is the additional power requirements from the flow of liquid and $P_L$ is the power lost, for example from bearings, vibration, noise etc.

EXAMPLES

Examples of Composition of the Present Invention

The following examples were made by simple mixing, as is known in the art. As can be seen from comparative example A, when hydrogenated castor oil is used as the structurant, the dynamic yield stress decays over time, when the composition also comprises ingredients which degrade the ester-bond, such as lipase. In contrast, when the amide rheology modifiers are used to provide structurant, the dynamic yield stress is maintained even in the presence of such hydrolysing ingredients.

| | Example A* wt % | EX. 1 wt % | EX. 2 wt % | EX. 3 wt % | EX. 4 wt % |
|---|---|---|---|---|---|
| Sodium hydroxide | 3.7 | 3.7 | 3.7 | 3.7 | 3.7 |
| 1,2-Propanediol | 2.8 | 2.8 | 2.8 | 2.8 | 2.8 |
| Citric Acid | 3.2 | 3.2 | 3.2 | 3.2 | 3.2 |
| sodium cumene sulphonate | 0.9 | 0.9 | 0.9 | 0.9 | 0.9 |
| Linear alkyl benzene sulphonic acid | 10 | 10 | 10 | 10 | 10 |
| C12-45 alkyl-7-ethoxylated | 4.4 | 4.4 | 4.4 | 4.4 | 4.4 |
| $C_{12-18}$ Fatty acid | 3.1 | 3.1 | 3.1 | 3.1 | 3.1 |
| Soil suspending alkoxylated polyalkylenimine polymer[1] | 1 | 1 | 1 | 1 | 1 |
| Amphiphilic alkoxylated grease cleaning polymer[2] | 0.4 | 0.4 | 0.4 | 0.4 | 0.4 |
| Monoethanolamine: $C_{12-14}$ EO•3•$SO_3H$ | 2.6 | 2.6 | 2.6 | 2.6 | 2.6 |
| Hydrogenated castor oil | 0.4 | 0 | 0 | 0 | 0 |
| N,N'-(azanediylbis(ethane-2,1-diyl))bis(12-hydroxyoctadecanamide)[3] | 0 | 0.6 | 0 | 0 | 0 |
| N,N'-((ethane-1,2-diylbis(azanediyl))bis(ethane-2,1-diyl))bis(12-hydroxyoctadecanamide)[4] | 0 | 0 | 1 | 0 | 0 |

-continued

| | Example A* wt % | EX. 1 wt % | EX. 2 wt % | EX. 3 wt % | EX. 4 wt % |
|---|---|---|---|---|---|
| N,N'-(ethane-1,2-diyl)bis(12-hydroxyoctadecanamide)[5] | 0 | 0 | 0 | 0.5 | 0 |
| N,N'-(ethane-1,2-diyl)bis(12-hydroxyoctadecanamide)[5] | 0 | 0 | 0 | 0 | 1 |
| Protease enzyme | 0.3 | 0.3 | 0.3 | 0.3 | 0.3 |
| Lipex ® | 0.5 | 0.5 | 0.5 | 0.5 | 0.5 |
| Minors (preservatives, stabilizers, solvents . . .) | up to 2% | up to 2% | up to 2% | up to 2% | up to 2% |
| Buffers (monoethanolamine) | to pH 8 | to pH 8 | to pH 8 | to pH 8 | to pH 8 |
| Water | up to 100% | up to 100% | up to 100% | up to 100% | up to 100% |
| Dynamic yield stress (Pa) | 0.34 | 0.48 | 0.1 | 0.1 | 0.3 |
| Dynamic yield stress (Pa) after 5 days at 25° C. | <0.01 | 0.49 | 0.12 | — | — |

*Comparative

[1]600 g/mol molecular weight polyethylenimine core with 24 ethoxylate groups per —NH and 16 propoxylate groups per —NH. Available from BASF (Ludwigshafen. Germany)

[2]Polyethylene imine polymer ethoxylated 10 propoxylated 7 (BASF, Germany)

[3]Synthesis of N,N'-(azanediylbis(ethane-2,1-diyl))bis(12-hydroxyoctadecanamide) and structuring premix preparation: 4.094 grams (4.4 mol) castor wax (hydrogenated castor oil) is charged into a flask, equipped with a stirrer and a condenser. The castor wax is melted at 95° C. and 681.2 grams (6.6 mol) diethylenetriamine are added with stirring. The resulting mixture is heated to from 155° C. to 160° C. and is kept at this temperature for 5 hours with stirring. The resulting reaction mixture is cooled to 120° C., 144 grams (8 mol) water and 540 grams (7.08 mol) 1,2-propanediol (propylene glycol) are added and the mixture is stirred for a further 1 hour at this temperature. The mixture is then cooled, providing a solid material having a melting range of 105° C. to 108° C. Then, the structuring premix is prepared in a pilot plant reactor unit equipped with and external heat exchanger. First the reactor is filled with 16.06 Kg of demi water and then 2.46 Kg of linear alkylbenzene sulphonate (91.2% purity) are added to the reactor and further neutralized with 0.519 Kg of monoethanolamine (96.2% purity). Mixture is heated to 85° C. and a blend of 600 grams of the synthesized N,N'-(azanediylbis(ethane-2,1-diyl))bis(12-hydroxyoctadecanamide) and 400 grams of propylene glycol, previously melted, is added to the reactor. The mixture is kept at 85° C. for 10 minutes and then a cooling rate of 1° C./min is applied till the structuring premix is at 35° C. Then, 200 grams ACTICIDE ® MBS 2550 from Thor (Germany) are added and premix is added to the formula at the level specified.

The following examples can be made using simple mixing:

| | EX. 5 wt % | EX. 6 wt % | EX. 7 wt % | EX. 8 wt % | EX. 9 wt % |
|---|---|---|---|---|---|
| Sodium hydroxide | 3.7 | 3.7 | 3.7 | 3.7 | 0 |
| 1,2-Propanediol | 2.8 | 3 | 2.8 | 3 | 6 |
| Citric Acid | 3.2 | 2.8 | 3.2 | 3.2 | 3.2 |
| sodium cumene sulphonate | 0.9 | 1 | 0.9 | 0 | 0 |
| Linear alkyl benzene sulphonic acid | 9.9 | 9 | 9.9 | 4.4 | 5.6 |
| C12-45 alkyl-7-ethoxylated | 4.4 | 6.8 | 4.4 | 5.2 | 6 |
| $C_{12-18}$ Fatty acid | 3.1 | 2.8 | 3.1 | 2 | 3.1 |
| Soil suspending alkoxylated polyalkylenimine polymer[1] | 1 | 1 | 1 | 0 | 0.2 |
| Monoethanolamine: $C_{12-14}$ EO•3•$SO_3H$ | 2.6 | 4.2 | 2.6 | 10.2 | 8 |
| Protease | 1.5 | 1.5 | 1.5 | 1 | 0.7 |
| Amylase | 0.7 | 0 | 0.7 | 0.4 | 0.2 |
| mannanase | 0.1 | 0 | 0.1 | 0 | 0 |
| xyloglucanase | 0.1 | 0 | 0.1 | 0 | 0 |
| pectate lyase | 0.4 | 0 | 0.4 | 0.4 | 0 |
| Lipex ® | 0.5 | 0.5 | 0 | 0 | 0 |
| N,N'-(((azanediylbis(ethane-2,1-diyl))bis(azanediyl))bis(ethane-2,1-diyl))bis(12-hydroxyoctadecanamide)[2] | 1 | 0 | 0 | 0 | 0.3 |
| N,N',N''-(nitrilotris(ethane-2,1-diyl))tris(12-hydroxyoctadecanamide)[3] | 0 | 0.4 | 0 | 0 | 0 |
| N,N'-(azanediylbis(ethane-2,1-diyl))bis(12-hydroxyoctadecanamide)[4] | 0 | 0 | 0.4 | 0.8 | 0.3 |
| Perfume | 0 | 0.4 | 0.5 | 0.5 | 0.4 |
| Perfume microcapsules[5] | 0.5 | 0.2 | 0 | 1 | 0 |

-continued

| | EX. 5 wt % | EX. 6 wt % | EX. 7 wt % | EX. 8 wt % | EX. 9 wt % |
|---|---|---|---|---|---|
| Minors (preservatives, stabilizers, solvents, brighteners . . .) | up to 2% | up to 2% | up to 2% | up to 2% | up to 2% |
| buffers (monoethanolamine) | to pH 8 | to pH 8 | to pH 8 | to pH 8 | to pH 8 |
| Water | up to 100% | up to 100% | up to 100% | up to 100% | up to 100% |

[1]600 g/mol molecular weight polyethylenimine core with 24 ethoxylate groups per —NH and 16 propoxylate groups per —NH. Available from BASF (Ludwigshafen, Germany)

[2]Synthesis of N,N'-(((azanediylbis(ethane-2,1-diyl))bis(azanediyl))bis(ethane-2,1-diyl))bis(12-hydroxyoctadecanamide and structuring premix preparation: 931 grams (1 mol) castor wax (hydrogenated castor oil) and 284 grams (1.5 mol) tetraethylenepentamine are reacted as in the synthesis of N,N'-((ethane-1,2-diylbis(azanediyl))bis(ethane-2,1-diyl))bis(12- hydroxyoctadecanamide). The resulting reaction mixture is cooled to 120° C., 128.2 grams (1.685 mol) 1,2-propanediol and 72 grams (4 mol) water are added and the mixture is stirred for a further 1 hour at this temperature. The mixture is then cooled, providing a solid material having a melting range of 77° C. to 79° C. Structuring premix is prepared in a rheoreactor (Discovery HR-1, TA Instruments). 6 grams of the prepared N,N'-(((azanediylbis(ethane-2,1-diyl))bis(azanediyl))bis(ethane-2,1-diyl))bis(12-hydroxyoctadecanamide and 144 grams of a 16% neutralized linear alkylbenzene sulphonate (96% purity)aqueous solution are loaded into the rheoreactor and heated to 90° C. the mixture is kept at 90° C. for 30 minutes. Then, mixture is cooled down to 20° C. at a rate of 0.5° C./min. Structuring premix is further used.

[3]Synthesis of N,N',N''-(nitrilotris(ethane-2,1-diyl))tris(12-hydroxyoctadecanamide) and structuring premix preparation: 630.8 grams (0.68 mol) castor wax (hydrogenated castor oil) and 128.8 grams (1.69 mol) 1,2-propanediol (propylene glycol) are charged into a flask, equipped with a stirrer and a condenser. The mixture is heated to 95° C. and homogenized by stirring. 99.1 grams (0.68 mol) tris-(2-aminoethyl)-amine are added and the resulting mixture is heated to 160° C. and kept at this temperature for 8 hours with stirring. The resulting reaction mixture is cooled, providing a solid material having a melting range of 102 to 105° C. Structuring premix is prepared as in example 4.

[4]As described in Example 1

[5]Suitable perfume microcapsules for use in this composition (which can be purchased from Appvion Inc, 825 East Wisconsin Ave, Appleton, WI 54911), are made as follows: 25 grams of butyl acrylate-acrylic acid copolymer emulsifier (Colloid C351, 25% solids, pka 4.5-4.7, (Kemira Chemicals, Inc. Kennesaw, Georgia U.S.A.) is dissolved and mixed in 200 grams deionized water. The pH of the solution is adjusted to pH of 4.0 with sodium hydroxide solution. 8 grams of partially methylated methylol melamine resin (Cymel 385, 80% solids, (Cytec Industries West Paterson, New Jersey, U.S.A.)) is added to the emulsifier solution. 200 grams of perfume oil is added to the previous mixture under mechanical agitation and the temperature is raised to 50° C. After mixing at higher speed until a stable emulsion is obtained, the second solution and 4 grams of sodium sulphate salt are added to the emulsion. This second solution contains 10 grams of butyl acrylate-acrylic acid copolymer emulsifier (Colloid C351, 25% solids, pka 4.5-4.7, Kemira), 120 grams of distilled water, sodium hydroxide solution to adjust pH to 4.8, 25 grams of partially methylated methylol melamine resin (Cymel 385, 80% solids, Cytec). This mixture is heated to 85° C. and maintained overnight with continuous stirring to complete the encapsulation process. A volume-mean particle size of 18 microns is obtained.

Further examples of the present invention are as follows:

| | Ex 10 wt % |
|---|---|
| 1,2-Propanediol | 15 |
| Monoethanolamine | 10 |
| Glycerol | 5 |
| Hydroxyethane diphosphonic acid | 1 |
| Potassium sulphite | 0.2 |
| C12-45 alkyl 7-ethoxylate | 20 |
| Linear Alkylbenzene sulphonic acid | 24.5 |
| Brightener 36 | 0.2 |
| C12-18 Fatty Acid | 16 |
| Ethoxysulphated Hexamethylene Diamine Dimethyl Quat | 2.9 |
| Soil Suspending Alkoxylated Polyalkylenimine Polymer[1] | 1 |
| magnesium chloride | 0.2 |
| N,N'-(azanediylbis(ethane-2,1-diyl))bis(12-hydroxyoctadecanamide)[2] | 0.15 |
| Water and minors | Up to 100% |

[1]600 g/mol molecular weight polyethylenimine core with 24 ethoxylate groups per —NH and 16 propoxylate groups per —NH. Available from BASF (Ludwigshafen, Germany)

[2]as described in example 1.

| | Ex. 11 wt % | Ex. 12 wt % |
|---|---|---|
| sodium hydroxide | 3.6 | 3.6 |
| 1,2-Propanediol | 4.4 | 4.4 |
| Ethanol | 0.9 | 0.9 |
| Citric Acid | 3.2 | 3.2 |

-continued

| | Ex. 11 wt % | Ex. 12 wt % |
|---|---|---|
| Linear alkyl benzene sulphonic acid | 7 | 7 |
| C12-45 alkyl-7-ethoxylated | 4 | 4 |
| $C_{12-18}$ Fatty acid | 4 | 4 |
| Soil Suspending Alkoxylated Polyalkylenimine Polymer[1] | 0.3 | 0.3 |
| Monoethanolamine: $C_{12-14}$ EO•3•$SO_3H$ | 6.9 | 6.9 |
| Perfume | 0.4 | 0.3 |
| Perfume microcapsules slurry[2] | 1.2 | — |
| Perfume microcapsules slurry[3] | — | 1.8 |
| N,N'-(azanediylbis(ethane-2,1-diyl))bis(12-hydroxyoctadecanamide)[4] | 0.2 | 0.35 |
| Minors (preservatives, stabilizers, solvents, brighteners . . .) | up to 2% | up to 2% |
| buffers (monoethanolamine) | To pH 8 | To pH 8 |
| Water | up to 100% | up to 100% |

[1]600 g/mol molecular weight polyethylenimine core with 24 ethoxylate groups per —NH and 16 propoxylate groups per —NH. Available from BASF (Ludwigshafen, Germany)
[2]As described in examples 5, 6 and 8
[3]86 wt % core/14 wt % wall Melamine Formaldehyde (MF) perfume microcapsule coated with a polyvinylformamide deposition aid
[4]As described in example 1

The following are examples of multi-compartment unit dose articles wherein a liquid detergent composition of the present invention is enclosed within a PVA film (Monosol M8630, having a thickness of 76 μm):

| | Example 13 | | | Example 14 | | | Example 15 | | | Example 16 | | |
|---|---|---|---|---|---|---|---|---|---|---|---|---|
| Compartment | 1 | 2 | 3 | 1 | 2 | 3 | 1 | 2 | 3 | 1 | 2 | 3 |
| Amount in compartment (mL) | 26 | 1.7 | 1.7 | 26 | 1.7 | 1.7 | 26 | 1.7 | 1.7 | 26 | 1.7 | 1.7 |
| Ingredients | Weight % | | | | | | | | | | | |
| $C_{11-16}$ alkylbenzene sulphonic acid | 18 | 20 | — | 18 | 23 | — | 18 | 20 | — | 18 | 23 | — |
| $C_{12-14}$ alkyl 7-ethoxylate | 17 | 17 | — | 17 | 15 | — | 15 | 17 | — | 17 | 15 | — |
| $C_{12-14}$ alkyl ethoxy 3 sulphate | 5.5 | 7.5 | — | 6 | 6 | — | 5.5 | 6 | — | 6 | 6 | — |
| Plurafac LF223 | — | — | 27.3 | — | — | 63 | — | — | 53 | — | — | 15.4 |
| Lutensol XP40 | — | — | 40 | — | — | 10 | — | — | 27 | — | — | 50 |
| Citric acid | 0.5 | — | — | — | — | — | 0.5 | — | — | — | — | — |
| $C_{12-18}$ Fatty acid | 13 | 13 | — | 16 | 8 | — | 13 | 13 | — | 16 | 8 | — |
| 4-Formyl Phenyl Boronic Acid | — | — | — | 0.03 | — | — | — | — | | — | — | |
| Ethoxylated polyethylenimine[1] | 2.2 | 2.2 | — | — | — | — | 2.2 | 2.2 | — | — | — | — |
| Hydroxyethane diphosphonic acid | 0.6 | 0.6 | — | — | 2.2 | — | 0.6 | 0.6 | — | — | 2.2 | — |
| EDTMP[2] | — | — | — | 0.4 | — | — | — | — | — | 0.4 | — | — |
| Brightener 49 | 0.2 | 0.2 | — | 0.3 | — | — | 0.2 | 0.2 | — | 0.3 | — | — |
| Protease (40.6 mg/g/)[3] | — | 2 | — | 1 | — | — | 1.2 | — | — | 1.5 | — | — |
| Natalase 200L (29.26 mg/g)[4] | 0.15 | — | — | 0.2 | — | — | 0.25 | — | — | 0.3 | — | — |
| Termamyl Ultra (25.1 mg/g)[4] | 0.1 | — | — | 0.1 | — | — | 0.12 | — | — | 0.15 | — | — |
| Mannaway 25L (25 mg/g)[4] | 0.1 | — | — | 0.1 | — | — | 0.12 | — | — | 0.15 | — | — |
| Lipase (16.91 mg/g) | — | — | 0.5 | — | — | — | — | — | — | — | — | — |
| Lipolex ® | 0.4 | — | — | | — | — | — | — | — | 1.5 | — | — |
| Whitezyme (20 mg/g)[4] | 0.1 | — | — | 0.1 | — | — | — | — | — | 0.15 | — | — |
| Encapsulated Lipase[5] | — | — | — | — | — | — | — | — | 0.5 | — | — | — |
| Phenyl Boronic Acid | — | 0.04 | — | — | — | — | — | — | — | — | — | — |
| Hueing dye[6] | — | — | 10 | — | — | 10 | — | — | 10 | — | — | 10 |
| OP305 premix | — | — | 4.2 | — | — | — | — | — | 4 | — | — | 4.5 |
| Water | 10.5 | 10 | 5.9 | 10.4 | 8 | 2 | 9.7 | 8 | 3 | 10 | 8 | 7 |
| $CaCl_2$ | — | — | — | — | 0.01 | — | — | 0.01 | — | — | 0.01 | — |
| Perfume | 1.7 | 1.7 | — | 1.5 | 0.5 | — | 1.5 | 0.5 | — | 1.5 | 0.5 | — |
| Perfume microcapsules | 1.2 | — | — | 1.5 | — | — | 0.4 | — | — | — | — | — |
| Hydrogenated castor oil | — | — | — | 0.1 | — | — | 0.1 | 0.08 | — | — | — | — |

-continued

| | Example 13 | | | Example 14 | | | Example 15 | | | Example 16 | | |
|---|---|---|---|---|---|---|---|---|---|---|---|---|
| Compartment | 1 | 2 | 3 | 1 | 2 | 3 | 1 | 2 | 3 | 1 | 2 | 3 |
| Structurant[7] | 0.15 | 0.1 | 0.15 | — | — | 0.15 | — | — | 0.3 | — | — | 0.2 |
| Minors (antioxidant, sulphite, etc.) | 2 | 2 | 2 | 2.2 | 2.2 | 2 | 2 | 2 | 2 | 2 | 2 | 2 |
| Monoethanolamine | To pH 8 | | | | | | | | | | | |
| 1,2 propanediol, ethanol | To 100 parts | | | | | | | | | | | |

[1]Polyethylenimine (MW = 600) with 20 ethoxylate groups per —NH.
[2]Ethylene diamine tetra(methylene phosphonic) acid
[3]Available from Genencor International, South San Francisco, CA.
[4]Available from Novozymes, , Denmark.
[5]As described in patent WO2015144784
[6]alkyl ethoxylate hueing dye present as a 25 wt % active solution of the hueing dye in 1,2-propanediol
[7]N,N'-(azanediylbis(ethane-2,1-diyl))bis(12-hydroxyoctadecanamide)

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid detergent composition comprising:

a) an amide that is a reaction product of an aliphatic polyamine with two, three, or four molecules, wherein the two, three, or four molecules are selected from fully saturated hydroxyl alkyl acids that comprise an alkyl group having from about 16 to about 20 carbons, and wherein the polyamine comprises at least one primary amino group for each saturated hydroxyl alkyl acid;

b) a surfactant; and c) a lipase enzyme;

wherein the detergent composition has a pH of greater than about 6.

2. The detergent composition according to claim 1, wherein the aliphatic polyamine comprises one primary amino group for each saturated hydroxyl alkyl acid.

3. The detergent composition according to claim 1, wherein the fully saturated hydroxyl alkyl acids are selected from the group consisting of: 12-hydroxyoctadecanoic acid, 12-hydroxynonadecanoic acid, 13-hydroxynonadecanoic acid, 12-hydroxyeicosanoic acid, 10-hydroxyhexadecanoic acid, 10-hydroxyoctadecanoic acid, and mixtures thereof.

4. The detergent composition according to claim 1, wherein the amide has the structure of formula (I):

$$R^1(CO)NH(CH_2)_x[NR^2(CH_2)_x]_yNH(CO)R^1 \quad (I)$$

wherein $R^1$ is a fully saturated alkyl chain containing at least about 1 hydroxyl group and from about 16 to about 20 carbons, groups $R^2$ are independently of one another hydrogen, methyl or $(CH_2)_xNH(CO)R^1$ with the proviso that no more than two group $R^2$ is $(CH_2)_xNH(CO)R^1$, x=2 or 3, and y=1, 2 or 3.

5. The detergent composition according to claim 1, wherein the amide has the structure of formula (II):

$$R^3(CO)NH(CH_2)_a(CHR^4)_b(CH_2)_aNH(CO)R^3 \quad (II)$$

wherein $R^3$ is a fully saturated alkyl chain containing at least about 1 hydroxyl group and from about 16 to about 20 carbons, $R^4$ is H, methyl or $NH(CO)R^3$, a is 1 or 2, and b is 0, 1 or 2.

6. The detergent composition according to claim 1, wherein the detergent composition comprises the amide at a level of from about 0.001 to about 10% by weight of the detergent composition.

7. The detergent composition according to claim 1, wherein the surfactant is present at a level of from about 1% to about 80% by weight of the detergent composition.

8. The detergent composition according to claim 1, wherein the lipase enzyme is encapsulated.

9. The detergent composition according to claim 1, wherein the composition further comprises particles, microcapsules, core-shell capsules, droplets, or mixtures thereof.

10. A unit dose article comprising one or more compartments, the one or more compartments formed by water-soluble film which fully encloses one or more inner volumes, wherein the unit dose article comprises a first liquid detergent composition, the first liquid detergent composition comprising a surfactant, and wherein the unit dose article further comprises an amide which is a reaction product of an aliphatic polyamine with two, three or four molecules selected from fully saturated hydroxyl alkyl acids which comprise an alkyl group having from about 16 to about 20 carbons, wherein the polyamine comprises at least one primary amino group for each saturated hydroxyl alkyl acid.

11. The unit dose article according to claim 10, wherein the unit dose article further comprises lipase enzyme, wherein the amide and the lipase enzyme are present in the same compartment.

12. A process for making a detergent composition, comprising the steps of:

a. providing a structuring or thickening premix comprising:

i. from about 2 to about 10% by weight of an amide which is a reaction product of an aliphatic polyamine with two or three molecules selected from fully saturated hydroxyl alkyl acids which comprise an alkyl group having from about 16 to about 20 carbons, wherein the polyamine comprises at least one primary amino group for each saturated hydroxyl alkyl acid;

ii. from about 8 to about 24% by weight of a surfactant;

iii. an alkali agent; and iv. solvent;

wherein the structuring or thickening premix has a pH of greater than about 6; and b. adding the structuring or thickening premix to a composition comprising a solvent and a surfactant.

13. The process according to claim 12, wherein the structuring or thickening premix comprises an anionic surfactant.

14. The process according to claim 12, wherein the structuring or thickening premix comprises a solvent selected from the group consisting of: water, methanol, ethanol, 1-propanol, 2-propanol, butanol, ethylene glycol, propylene glycol, diethylene glycol, dipropylene glycol, oligoethylene glycols with a molecular weight of less than about 400 g/mol, oligopropylene glycols with a molecular weight of less than about 400 g/mol, monoethers of said glycols with C1-3 alcohols, glycerol, and mixtures thereof.

* * * * *